US005471372A

United States Patent [19]

Mamelson et al.

[11] Patent Number: 5,471,372

[45] Date of Patent: Nov. 28, 1995

[54] LIGHTING SYSTEM FOR COMMERCIAL REFRIGERATOR DOORS

[75] Inventors: Richard A. Mamelson, Crown Point, Ind.; Richard C. Kim, Ann Arbor; Damon F. Kvamme, Plymouth, both of Mich.

[73] Assignee: Ardco, Inc., Chicago, Ill.

[21] Appl. No.: 163,741

[22] Filed: Dec. 6, 1993

[51] Int. Cl.[6] ..... F21V 5/02; F25D 27/00

[52] U.S. Cl. ..... 362/92; 362/223; 362/260; 362/294; 362/309; 362/310; 362/339

[58] Field of Search ..... 362/92, 223, 260, 362/33, 294, 297, 309, 310, 329, 339, 346, 340; 312/116

[56] References Cited

U.S. PATENT DOCUMENTS

| | | | |
|---|---|---|---|
| 2,248,638 | 7/1941 | Merton | 359/592 |
| 2,293,924 | 8/1942 | Swanson | 362/223 |
| 2,476,352 | 7/1949 | Bissell et al. | 362/223 |
| 2,515,584 | 7/1950 | Benson | 62/264 |
| 2,533,661 | 12/1950 | Arenberg et al. | 362/319 |
| 2,551,710 | 5/1951 | Slaughter | 362/355 |
| 2,563,635 | 8/1951 | Askin | 362/223 |
| 2,583,939 | 1/1952 | French et al. | 362/223 |
| 2,694,137 | 11/1954 | Williams | 362/413 |
| 2,741,694 | 4/1956 | Thomstad et al. | 362/340 |
| 2,807,710 | 9/1957 | Williams | 362/223 |
| 2,913,575 | 11/1959 | Lipscomb | 362/223 |
| 2,995,649 | 8/1961 | Cyrus | 362/92 |
| 3,242,331 | 3/1966 | Behringer et al. | 362/223 |
| 3,248,533 | 4/1966 | Mathis | 362/222 |
| 3,448,260 | 6/1969 | Wince et al. | 362/328 |
| 3,808,495 | 4/1974 | Win | 313/110 |
| 3,988,609 | 10/1976 | Lewin | 362/339 |
| 4,017,130 | 4/1977 | Hanson | 312/128 |
| 4,312,190 | 1/1982 | Ibrahim et al. | 62/255 |
| 4,371,916 | 2/1983 | De Martino | 362/340 |
| 4,388,675 | 6/1983 | Lewin | 362/225 |
| 4,390,930 | 6/1983 | Herst et al. | 362/224 |
| 4,393,323 | 7/1983 | Hübner | 313/110 |
| 4,432,044 | 2/1984 | Lautzenheiser | 362/223 |
| 4,450,509 | 5/1984 | Henry | 362/216 |

(List continued on next page.)

FOREIGN PATENT DOCUMENTS

| | | |
|---|---|---|
| 0132687A1 | 7/1984 | European Pat. Off. . |
| 0198088 | 10/1986 | European Pat. Off. . |
| 627.376 | 10/1927 | France . |
| 8533752.8 | 1/1986 | Germany . |
| 3541573A1 | 5/1987 | Germany . |
| 2903993A1 | 8/1990 | Germany . |
| 4006004A1 | 8/1991 | Germany . |
| 75555 | 3/1986 | Taiwan . |
| 921417 | 3/1963 | United Kingdom . |
| 1559356 | 1/1980 | United Kingdom . |
| 2226120 | 6/1990 | United Kingdom . |
| 2248676 | 4/1992 | United Kingdom . |
| WO93/20733 | 10/1993 | WIPO . |

OTHER PUBLICATIONS

Book: Eugene Hecht and Alfred Zajac, Addison–Wesley Publishing Company, Inc., *Optics,* "Geometrical Optics," pp. 108–110 and 167–169, Redding, Massachusetts, 1979.

Book: Laurin Publishing Co., *The Photonics Dictionary,* p. D–23, Pittsfield, Massachusetts, 1991.

Paper: Technical Education Research Center– SW, "Course VI Laser and Electro–Optic Components," pp. 20–21, Waco, Texas, Aug. 1980.

*Primary Examiner*—Ira S. Lazarus
*Assistant Examiner*—L. Heyman
*Attorney, Agent, or Firm*—Leydig, Voit & Mayer, Ltd.

[57] ABSTRACT

A commercial refrigerator cabinet is illuminated by fluorescent lamps which are located closely behind insulated glass doors for closing the cabinet. Each lamp is located behind a reflector and is at least partially enclosed by a clear plastic lens having multiple facets on its inner side. The reflector and the lens cause the light emitted from the lamp to reflect and refract in such a manner as to distribute the light substantially uniformly on products located at various distances from the lamp and to reduce glare in the immediate vicinity of the lamp.

29 Claims, 7 Drawing Sheets

U.S. PATENT DOCUMENTS

| | | | |
|---|---|---|---|
| 4,496,216 | 1/1985 | Cowan | 359/566 |
| 4,573,111 | 2/1986 | Herst et al. | 362/340 |
| 4,609,978 | 9/1986 | Hsieh et al. | 362/335 |
| 4,611,266 | 9/1986 | Schwartz | 362/226 |
| 4,644,454 | 2/1987 | Herst et al. | 362/224 |
| 4,660,934 | 4/1987 | Akiba et al. | 430/5 |
| 4,734,836 | 3/1988 | Negishi | 362/311 |
| 4,792,197 | 12/1988 | Inoue et al. | 359/15 |
| 4,793,680 | 12/1988 | Byron | 385/37 |
| 4,806,454 | 2/1989 | Yoshida et al. | 430/321 |
| 4,845,601 | 7/1989 | Podbury et al. | 362/125 |
| 4,858,087 | 8/1989 | Hartshorn | 362/219 |
| 4,924,368 | 5/1990 | Northrop et al. | 362/376 |
| 4,979,078 | 12/1990 | Amstutz et al. | 362/125 |
| 4,997,747 | 3/1991 | Yoshida et al. | 430/321 |
| 5,016,146 | 5/1991 | Kaspar | 362/92 |
| 5,020,252 | 6/1991 | De Boef | 362/260 |
| 5,022,720 | 6/1991 | Fevig et al. | 312/223 |
| 5,034,861 | 7/1991 | Sklenak et al. | 362/92 |
| 5,072,343 | 12/1991 | Buers | 362/125 |
| 5,080,465 | 1/1992 | Laude | 359/571 |
| 5,116,461 | 5/1992 | Lebby et al. | 156/643 |
| 5,155,380 | 5/1992 | Huisingh et al. | 362/33 |
| 5,199,786 | 4/1993 | Baliozian | 362/297 |
| 5,297,863 | 3/1994 | Richardson et al. | 312/128 |
| 5,301,092 | 4/1994 | Santosuosso et al. | 362/125 |

LIGHTING SYSTEM FOR COMMERCIAL REFRIGERATOR DOORS

BACKGROUND OF THE INVENTION

The present invention relates generally to commercial refrigerator units of the type which have glass doors for viewing merchandise from the front side thereof, and more particularly, to lighting systems for illuminating products contained within the refrigerator.

Commercial refrigeration units of the type employed in supermarkets and other commercial establishments typically comprise a plurality of swingable insulated glass doors which are adapted to permit viewing of merchandise within the refrigerator by passing customers. It is necessary that the products be displayed in a pleasing and visible manner while the doors are in their closed positions. For this purpose, it is customary to employ a vertically disposed fluorescent light on at least one side of each door in order to illuminate the merchandise contained within the refrigerator. Heretofore, this has presented various problems.

Since the light intensity dramatically reduces at farther distances from the light source, items closely adjacent the light source typically are brightly lit while the items spaced horizontally from the source by substantial distances often are not sufficiently illuminated. Such inconsistency in the lighting effect on the goods can be very distractive. This problem is particularly troublesome in refrigerator units because the colder the fluorescent bulb becomes, the lower is the light output, which further reduces the illumination of products which are located further away from the bulb. Moreover, it is desirable that the light not be directed outwardly of the display case in the direction of the customer to create a glare. Indeed, in long refrigerator units which have a multiplicity of pairs of swinging doors, and hence a multiplicity of vertical lights, the outward shining of the lights creates what is referred to as a zebra effect, which again is distractive to displayed merchandise.

Various approaches have been taken for overcoming the foregoing problems, but none have been entirely satisfactory. Utilizing a translucent cover over the fluorescent lamp serves to soften the light output, but does not correct the uneven distribution of light on the displayed goods. Attempts to focus the light output through lenses have not been successful. Focusing lenses have limitations which heretofore have prevented the light from being diffused uniformly on the goods, or which have prevented the elimination of the zebra effect.

SUMMARY OF THE INVENTION

The general aim of the present invention is to provide a commercial refrigerator lighting system which enables more aesthetically pleasing display of merchandise within the refrigerator cabinet.

Another object of the invention is to provide a lighting system as characterized above which effects substantially uniform illumination of the displayed merchandise.

A further object is to provide a lighting system of the above kind which neither creates a glare to the passing customer nor which creates a zebra effect in a long display cabinet in which a plurality of vertically disposed fluorescent lamps are located along the length thereof.

Another object is to provide a lighting system of the foregoing type in which the light output of fluorescent bulbs used in the system is substantially unaffected by the cold temperature within the refrigerator case.

A further object is to provide a lighting system of such type which is relative compact in construction and which lends itself to economical installation.

In a more detailed sense, the invention resides in the provision of a lighting system in which properties of both reflection and refraction are utilized to produce an improved illumination gradient across a target plane located in close proximity to the bulb, this being achieved through the use of a non-imaging lens/reflector unit for redirecting light traveling in one direction and for causing such light to combine with light emanating from another part of the bulb.

These and other objects and advantages of the invention will become more apparent from the following detailed description when taken in conjunction with the accompanying drawings.

Figure 1:
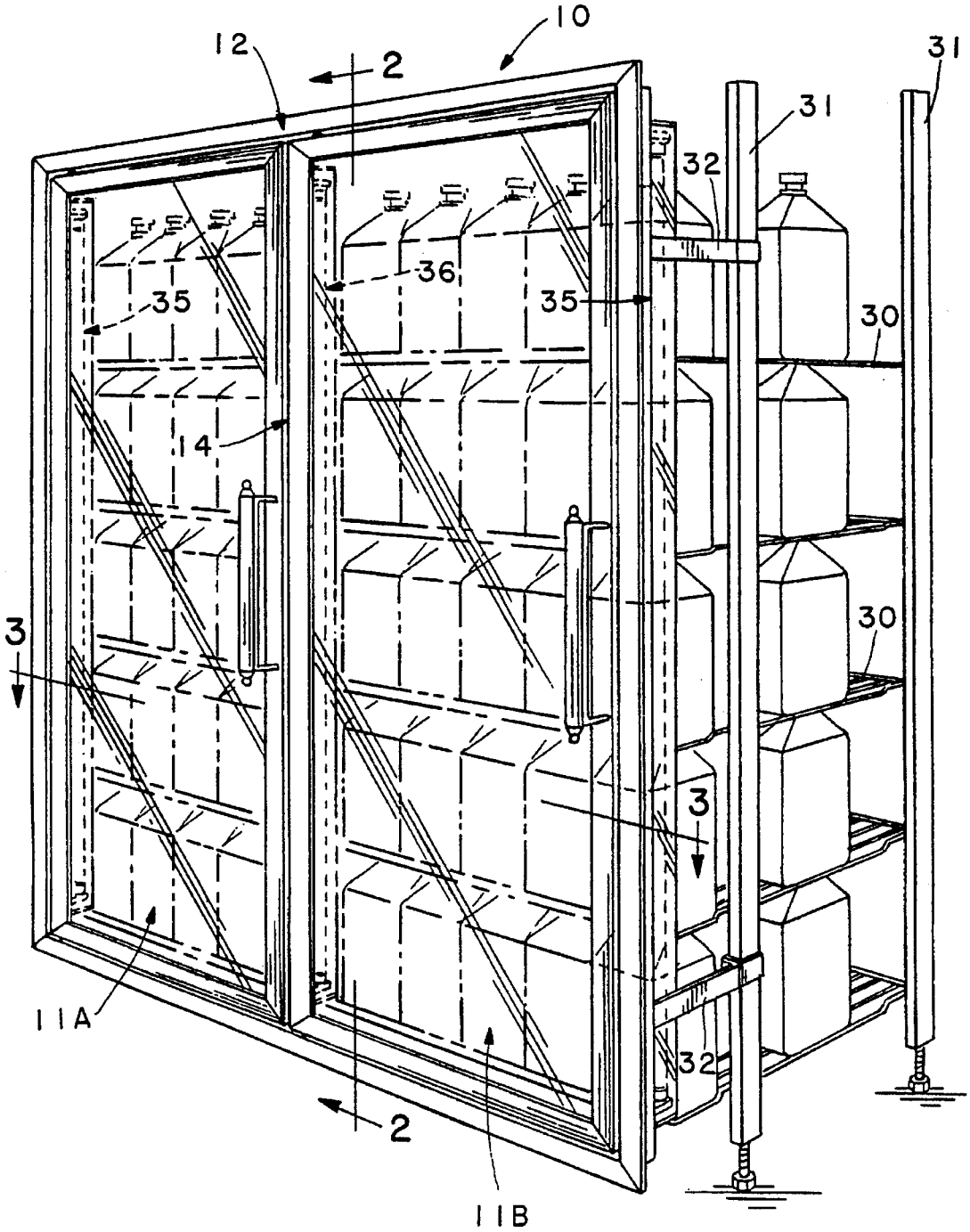
FIG. 1 is a front perspective view of a typical commercial refrigerator unit equipped with a new and improved lighting system incorporating the unique features of the present invention.
Figure 2:
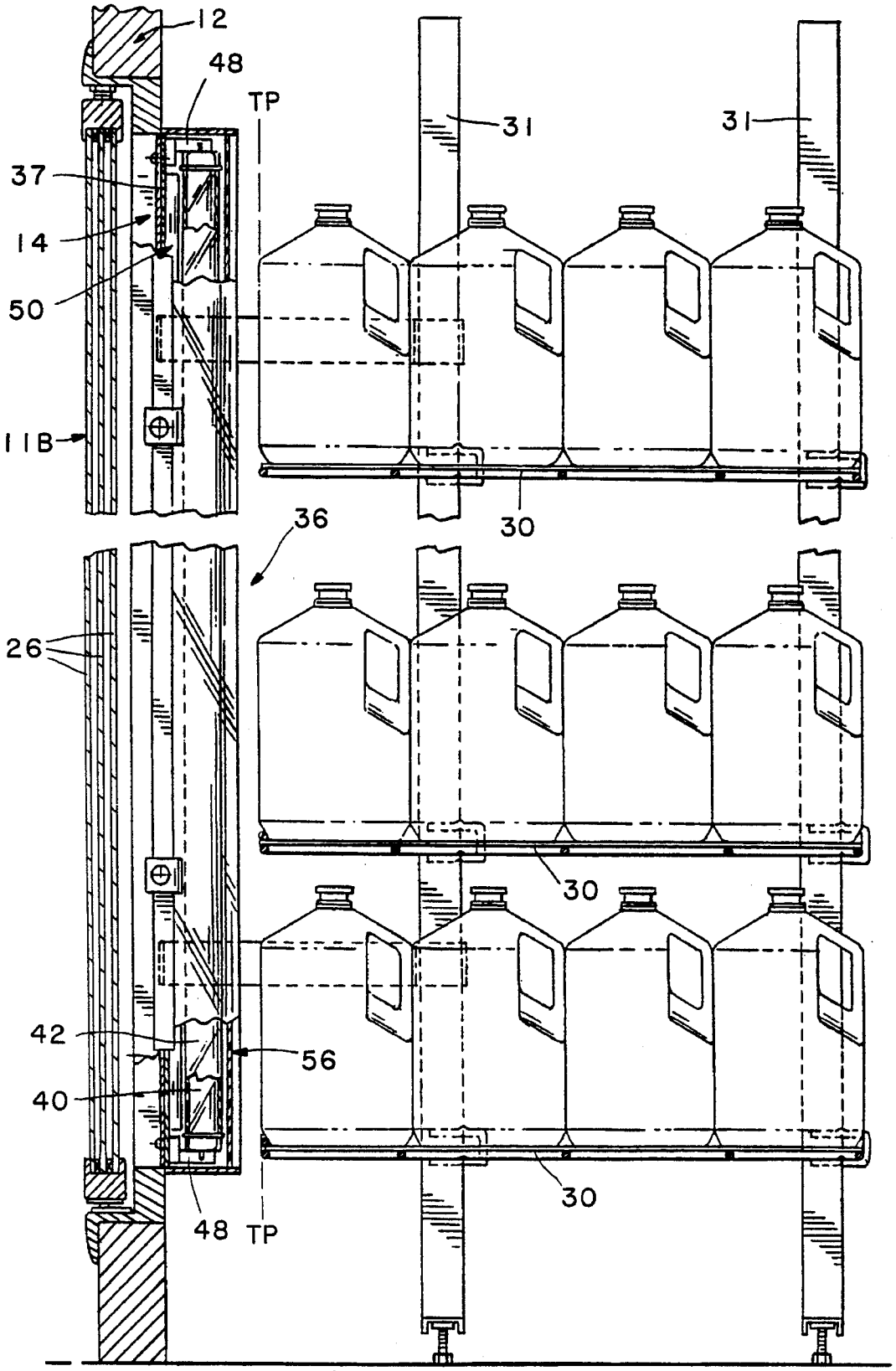
FIGS. 2 and 3 are enlarged fragmentary cross-sections taken substantially along the lines 2—2 and 3—3, respectively, of FIG. 1.

While the invention is susceptible of various modifications and alternative constructions, a certain illustrated embodiments hereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE PREFERRED EMBODIMENTS

Referring now more particularly to the drawings, there is shown an illustrative refrigerator door assembly 10 comprising a pair of insulated glass doors 11A and 11b each mounted for swinging movement in a door mounting cabinet frame 12 which in turn is mounted within an opening in a front wall 13 (FIG. 3) of a refrigerator cabinet or the like. It will be understood that the door assembly 10 is particularly adapted for use in free standing refrigerator or freezer cases or built-in coolers or cabinets of the type used in supermarkets and other retail stores to display refrigerated or frozen merchandise. The door mounting frame 12, which may be of a conventional construction, extends about the periphery of the opening in the wall 13 and includes a center frame member or mullion 14 extending vertically between the top and bottom perimeters of the frame to provide rigidity for the frame 12 and defining a sealing surface against which sides of the doors 11A and 11B engage when in a closed condition.

In addition to the center mullion 14, the cabinet frame 12 includes a plurality of frame members 15 (FIGS. 3 and 4), preferably in the form of extrusions made of aluminum or other suitable metal material, arranged in a rectangular configuration about the periphery of the cabinet opening. The illustrated frame members 15 have a generally Z-shaped configuration comprising a front flange 16 (FIG. 4), a rear flange 18, and a web 19 extending therebetween. The front and rear flanges 16, 18 project in opposite directions, generally at right angles to the web 19. A plate 20 located forwardly of the flange 18 provides a sealing surface against which the doors 11A and 11B close. An insulating strip 21, preferably made of plastic, is interposed between the frame member web 19 and the cabinet wall 13 and, in this case, extends rearwardly into the cabinet.

The center mullion 14 is generally similar to the frame members 15 and includes a vertically extending plate 22 (FIG. 5) defining a sealing face for the doors 11A and 11B. In this particular instance, the door 11B is hinged at 23 adjacent the mullion while the door 11A is hinged at 24 (FIG. 4) near one of the vertically extending portions of the frame members 15. Thus, the free edge of the door 11B seals against the plate 20 of the opposite vertically extending frame member portion while the free edge of the door 11A seals against the plate 22 of the mullion 14.

The insulated glass doors 11A and 11B may be of a conventional type, which include an insulated glass unit comprising a plurality of glass panes 26 (FIG. 5) disposed in parallel side-by-side relation and separated by spacers 27. For supporting the glass unit and providing a decorative finish trim around the perimeter thereof, each door has an outer frame assembly, the rear side of which carries a gasket 28 for sealing engagement with the plates 20 and 22.

For supporting merchandise within the refrigerator cabinet, a plurality of vertically spaced shelves 30, such as wire rod type, are provided. The shelves 30 typically are supported on front and rear support posts 31, the front posts being secured to the door frame 12 by brackets 32 or other suitable means. Herein, there are left and right hand tiers of shelves located at opposite sides of the center mullion 14.

To illuminate merchandise within the refrigerator cabinet, vertical light fixtures 35 and 36 are supported rearwardly of the door frame 12 immediately in front of the shelves 30. Herein, an end light fixture 35 is located adjacent each vertically extending portion of the frame member 15 while a center light fixture 36 is located directly behind the center mullion 14 (see FIG. 3).

Figure 4:
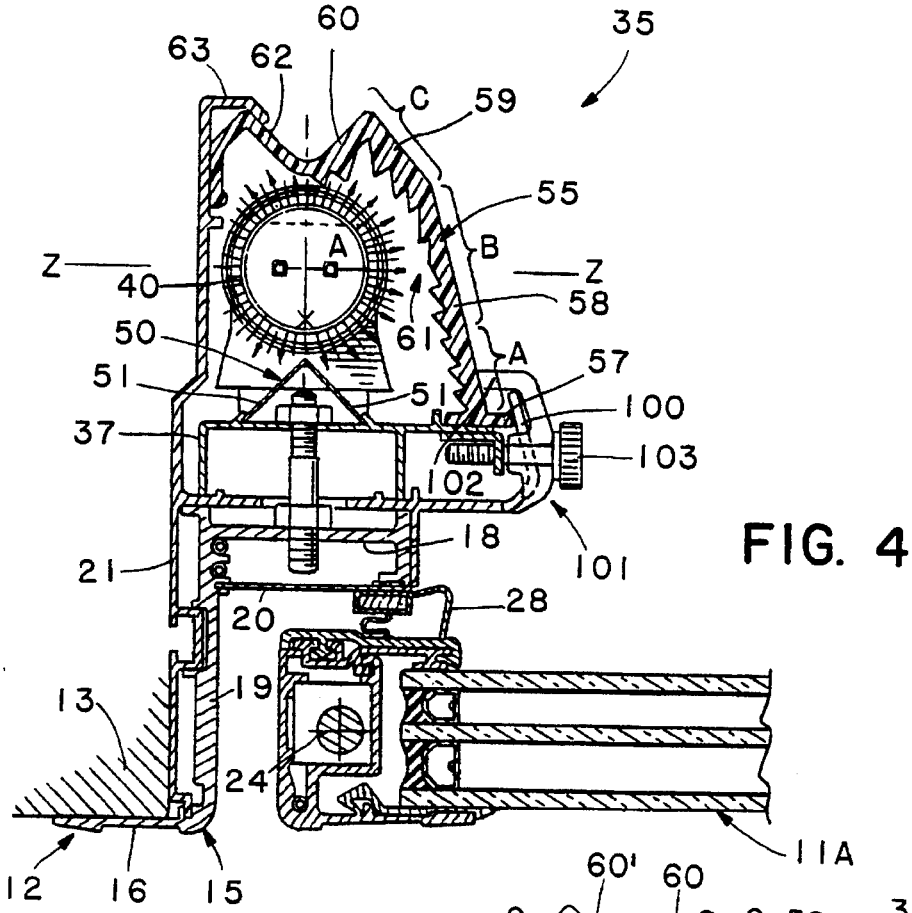
FIG. 4 is an enlarged view of one type of light fixture shown in FIG. 3.
Figure 5:
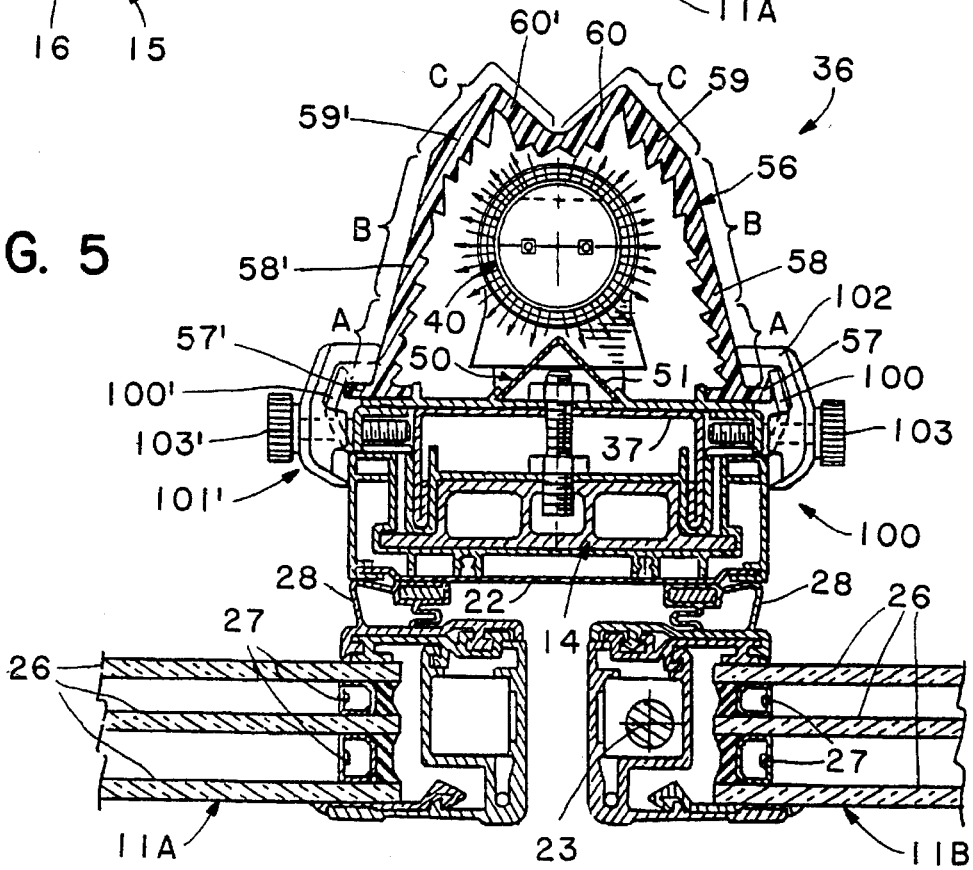
FIG. 5 is an enlarged view of another type of light fixture shown in FIG. 3.

Each light fixture 35, 36 in this instance comprises an elongated channel-shaped base 37 extending vertically of the doors 11A and 11B. The bases for the two end fixtures 35 are attached to the flanges 18 of the frame members 15 (see FIG. 4) while the base for the center fixture 36 is attached to the mullion 14 as shown in FIG. 5. Electrical sockets 38 (FIG. 6) are attached by screws 39 to the upper and lower end portions of each base and may be connected to an electrical outlet on the frame 12, as is known in the art. A replaceable light bulb 40, which preferably is of the fluorescent type, includes terminals 41 which are adapted to be plugged into the sockets. Each bulb extends vertically and is spaced just a short distance in front of the shelves 30.

In order to insulate each bulb 40 from the refrigerated temperatures in the cabinet, a transparent plastic, elongated tube 42 (FIG. 6) is concentrically mounted about the bulb to define an air insulating space 43 between the bulb and the tube. In order to support the insulating tube 42 concentrically about the bulb 40, plastic end caps 44 are provided at opposite ends of the tube. Each end cap has a first tubular portion 45 over which an end of the tube is snugly telescoped and a radial locating flange 46 against which the end of the tube abuts. The end cap has a second tubular portion 47 for receiving the end portion of the bulb and formed with an end wall through which the terminals 41 project. Integral with the second tubular portion of the end cap is a sleeve 48 adapted to telescope releasably over the socket 38 to enable the terminals 41 to plug into the female contacts of the socket.

Figure 3:
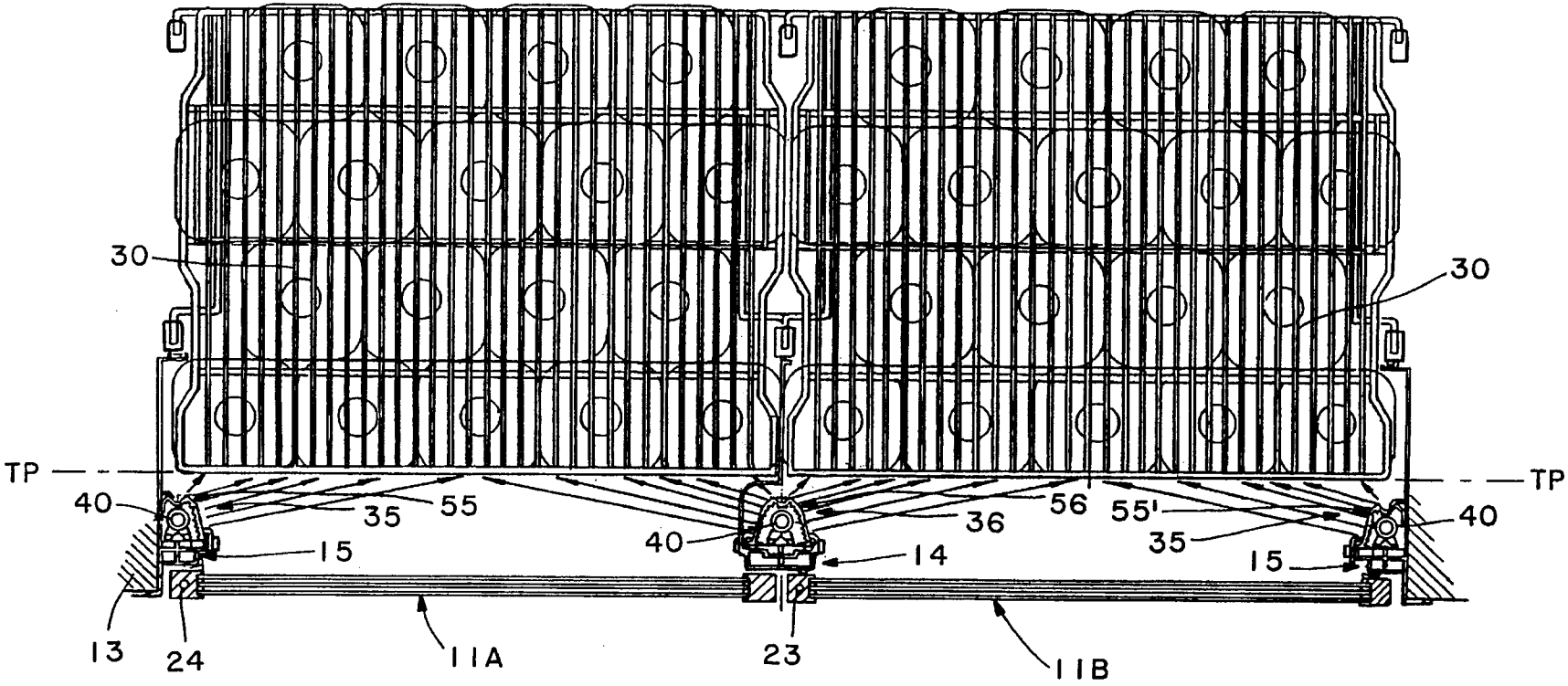

As is apparent from FIG. 3, the two light fixtures 35 are located just in front of the outboard ends of the shelves 30 while the light fixture 36 is located just in front of the center of the two tiers of shelves. In accordance with the present invention, each light fixture is constructed so as to effect a substantially uniform distribution of light energy horizontally across a target plane TP which herein is a forwardly facing vertical plane containing the front edges of the shelves. As a result of the construction of the fixtures, the intensity of the light at locations remote from the fixtures more nearly approximates the intensity at locations immediately adjacent the fixtures so as to more attractively illuminate the merchandise.

More specifically, each of the fixtures 35, 36 herein comprises a vertically extending reflector 50 supported on the base 37 and located between the base and the front of the bulb 40. Each reflector is a substantially V-shaped member having two wings 51 disposed at right angles to each other and joining one another at an apex 52 (FIG. 9) which points toward the bulb and which is centered laterally with respect to the axis A of the bulb. The reflector is made of sheet metal and the rearwardly facing surfaces of the wings have a shiny, mirror-like finish. Lips 53 (FIG. 9) projecting from the base 37 receive the free edge portions of the wings and serve to hold the reflector in assembled relation with the base.

In carrying out the invention, a uniquely constructed lens both reflects and refracts light from the bulb 40 of each fixture 35, 36 and coacts with the reflector 50 of the fixture to distribute the light energy substantially uniformly across the target plane TP. The lens for the left end fixture 35 is shown in FIG. 4, has been indicated generally by the reference numeral 55 and will be described in detail. The lens 55' (FIG. 3) for the right end fixture 35 is a mirror image of the lens 55 and thus need not be specifically described. The center fixture 36 includes a lens 56 which will be described subsequently.

Referring now to FIG. 4, the lens 55 is extruded from a single piece of clear acrylic and has a nominal wall thickness of about 0.010". The lens may best be described as being partly transparent in that an object within the lens can be seen and distinguished but not with the clarity that would prevail with a truly transparent lens.

The forward end of the lens 55 includes a laterally extending flange 57 (FIG. 4) which seats against the rear face of the base 32. The flange 57 is located forwardly and to the right of the bulb 40 of the left-hand light fixture 35. Speaking primarily geometrically rather than optically, the lens 55 includes a first portion 58 joined to the flange 57 and inclined at an acute included angle relative to the base 37 such that the first portion 58 converges toward the bulb 40 as it progresses rearwardly. The first portion 58 of the lens extends rearwardly from the flange to a location approximately even with the rear side of the bulb.

The lens 55 includes a second portion 59 (FIG. 4) which is inclined at an obtuse included angle relative to the first portion 58 and which extends rearwardly from the rear end of the first portion and toward a vertical plane X containing the axis A of the bulb 40 and disposed perpendicular to the target plane TP at the front of the shelves 30. The second lens portion 59 extends rearwardly to a location beyond the rear side of the bulb and terminates prior to reaching the plane X. A third lens portion 60 is joined to the rear end of the second lens portion 59, is inclined at an acute included angle relative thereto and extends forwardly therefrom to a position spaced just forwardly of the rear side of the bulb 40 and located in the plane X. The inner sides of the first, second and third portions 58, 59 and 60 are formed with multiple facets 61 which will be described subsequently. The lens also includes a non-faceted portion 62 which engages the side of the insulating strip 21, the rear end of the strip being formed with a flange 63 which hooks around part of the non-faceted portion.

As mentioned above, the inner sides of the portions 58, 59 and 60 of the lens 55 includes multiple facets 61 which herein are in the form of vertically extending and generally V-shaped ribs. Again describing primarily geometric characteristics as opposed to optical characteristics, the inner side of the first lens portion 58 includes a first group of generally V-shaped facets 65 (FIGS. 8 and 9) each having long and short legs 66 and 67 which join one another at acute included angles. The long legs 66 of the facets 65 are generally parallel to one another and face generally forwardly toward the reflector 50. The short legs 67 of the facets 65 also are generally parallel to one another and face generally rearwardly away from the reflector. In this instance, the lens includes five facets 65. Those facets are located between the base 37 and a vertical plane Z extending perpendicular to the plane X and containing the axis A of the bulb. The plane Z, of course, extends parallel to the target plane TP.

The inner side of the first portion 58 of the lens 55 also includes a single generally V-shaped facet 68 (FIG. 8) whose legs 69 join one another at an obtuse included angle having an apex located closely adjacent the plane Z. The facet 68 is located next to the rearmost facet 65 and forms a transition between those facets and another group of facets 70 (FIGS. 7 and 8) formed on the inner side of the first lens portion 58. There are two such facets, with each being generally V-shaped and having long and short legs 71 and 72 which join one another at an acute included angle. The long legs 71 of the facets 70 extend generally parallel to and face the plane X while the short legs 72 thereof face generally forwardly.

The inner side of the second portion 59 of the lens 55 includes a group of three facets 73 (FIG. 7) which are generally similar to the facets 70. That is, each facet 73 includes long and short legs 74 and 75 joining one another at an acute included angle, with the long legs 74 extending generally parallel to and facing the plane X and with the short legs 75 facing generally forwardly.

Figure 7:
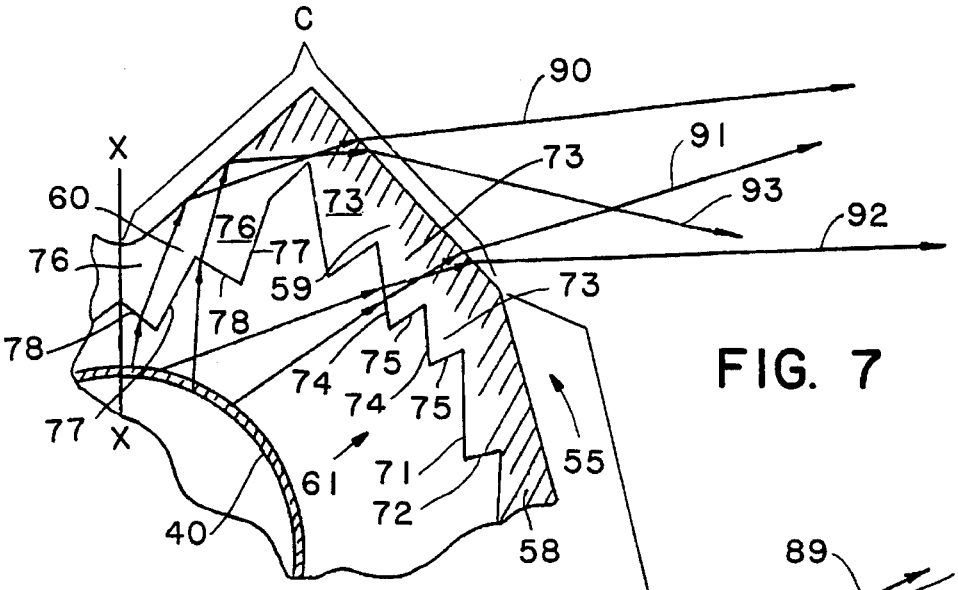
FIGS. 7, 8 and 9 are diagrammatic views showing the propagation of light rays from different sections of the light fixture of FIG. 4.

As shown most clearly in FIG. 7, the third lens portion 59 includes a plurality (herein, two) of generally V-shaped facets 76 each having long and short legs 77 and 78 which join one another at an acute included angle. The long legs 77 of the facets 76 are generally parallel to one another and face generally away from the plane X and the reflector 50. The short legs 78 of the facets 76 also are generally parallel to one another and face generally toward the reflector. The rear end of the short leg 78 of the forwardmost facet 76 is located in the plane X.

Figure 8:
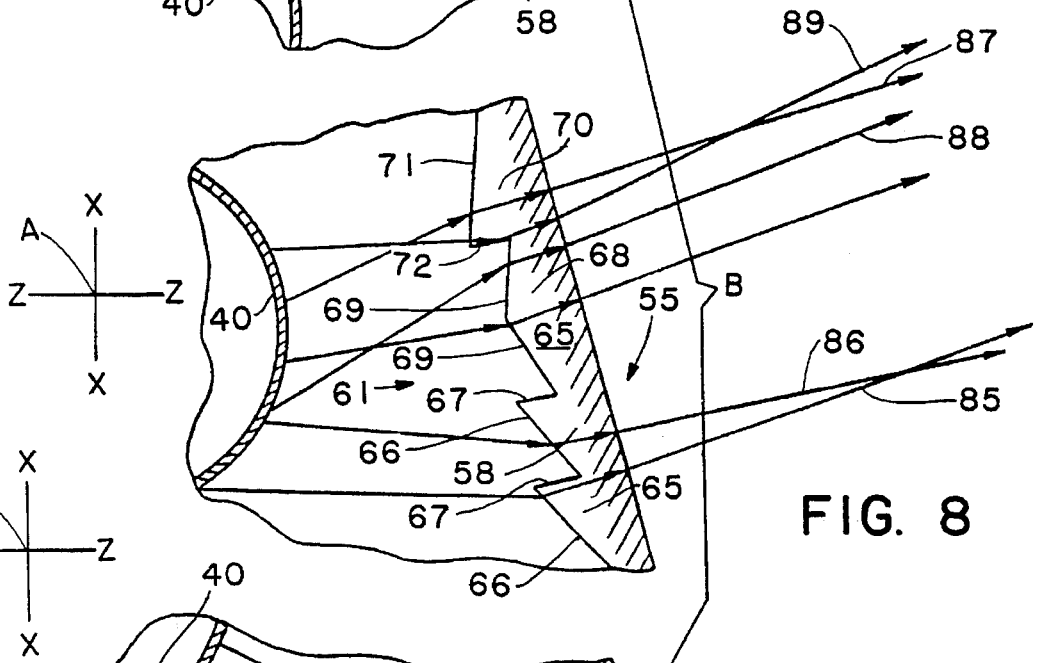
Figure 9:
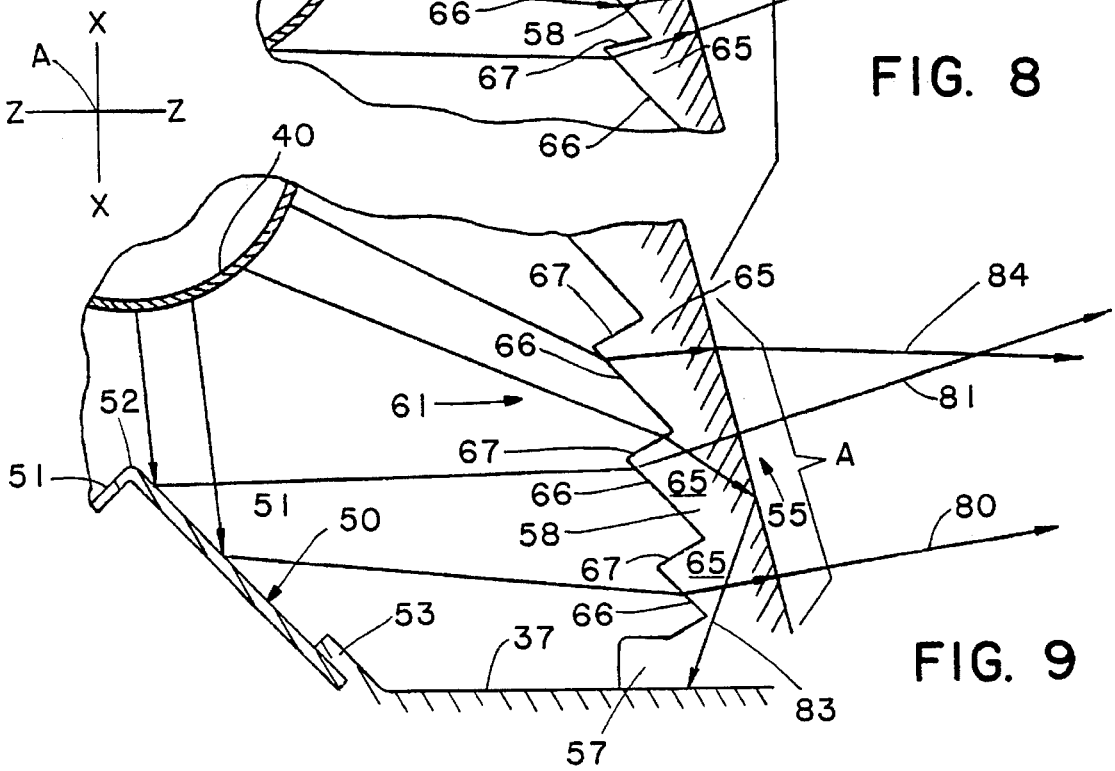

From an optical standpoint, the lens 55 is considered to comprise three sections A, B and C (FIG. 4 and FIGS. 7–9) designed to send as much light as possible horizontally to the right within the target plane TP. Section A of the lens includes part of the first lens portion 58 and extends rearwardly from the flange 57 to a location somewhat rearwardly of the reflector 50 and approximately to the short leg 67 of the third facet 65 from the front. The main function of section A of the lens is to refract light that is reflected off of the reflector 50 and to redirect it toward the target plane TP. Rays 80 and 81 shown in FIG. 9 are illustrative of this phenomenon. Each facet 65 of section A, however, also plays other important roles to enhance the performance of the fixture 35. Light rays from other parts of the bulb 40 will strike the short legs 67 of the facets and take one of two paths. The majority of such rays, as exemplified by the ray 83, pass through the short legs 66 of the facets 65 and, upon reaching the outer side of the lens 55, are totally internally reflected and travel forwardly to strike the base 57. As a result, light which otherwise would have escaped to outside the door 11A is trapped blocked and absorbed and cannot be seen by a person looking into the door. Not all of the rays from the bulb 40 can be controlled and thus there will be some leakage in undesirable directions as exemplified by the ray 84 in FIG. 9. As a result of refraction by the facets 65, however, the angles of such rays are significantly altered so that a person looking into the door 11A from the outside cannot directly see or image the bulb 40.

Optical section B of the lens 55 extends generally from section A to the rear end of the long leg 74 of the forwardmost facet 73. Section B is somewhat functionally similar to a large facet Fresnel lens but has been optimized to control rays from different portions of the bulb 40. The angles of the long legs 66 of the facets 65 are comparatively large relative to vertical and thus provide more bending of the rays. This is beneficial because rays such as the rays 85 and 86 (FIG. 8) generally originate from points located forwardly of the long legs 66 of the facets 65, thus requiring that the rays be bent through large angles in order to redirect the light toward the target plane TP. The facets 70 of section B are oriented in the opposite direction from the facets 65 and, in this part of the lens 55, the rays are bent away from the end portion of the target plane TP and are redirected toward the right thereof as indicated by the rays 87 and 88 (FIG. 8). In some cases, the facet 70 promotes light redistribution as displayed by the ray 89 in FIG. 8. That ray enters the facet 70 through its long leg 71, is reflected off of the short leg 72 because of total internal reflection and continues on to illuminate the target plane TP.

Optical section C of the lens 55 comprises the second and third lens geometric portions 59 and 60. The main function of the portion 60 of section C is to cause the light to reflect internally at the outer surface of the lens. The facets 73 and 76 of section C are oriented such that refraction at the inner side of the lens is minimized. As a result, light from the rearward area of the bulb 40 as exemplified by the ray 90 travels in a relatively undeviated path as it passes through the inner side of the lens. When such light reaches the outer surface of the lens, its angle is such that total internal reflection results, causing the light to be directed away from the end of the target plane TP and toward the right thereof. Rays such as the ray 91 are refracted away from the vicinity of the bulb 40 in order to illuminate the center of the target plane. Rays 92 and 93 do not directly strike the target plane but, as a result of reflection and/or refraction, are deviated away from the vicinity of the bulb 40 so as to reduce the light intensity in that vicinity and impart uniformity to the illumination gradient. The non-faceted section 62 of the lens 35 coacts with the insulating strip 21 to define baffling at the left side of the fixture 35 to direct light toward the right thereof.

FIG. 5 shows the lens 56 for the center light fixture 36. The right side of such lens is identical to the right side of the lens 55 in that the right side of the lens 56 includes first, second and third geometric portions 58, 59 and 60 identical to the first, second and third portions 58, 59 and 60, respectively, of the lens 55. The left side of the center lens 56 includes fourth, fifth and sixth portions 58', 59', and 60' which are mirror images of the first, second and third portions 58, 59 and 60, respectively, of the lens 56. The fourth portion 58' of the lens 56 includes a flange 57' which seats against the base 37 on the side of the reflector 50 opposite the flange 57 while the sixth portion 60' of the lens 56 is joined to the third portion 60 thereof in the plane X.

Figure 10:
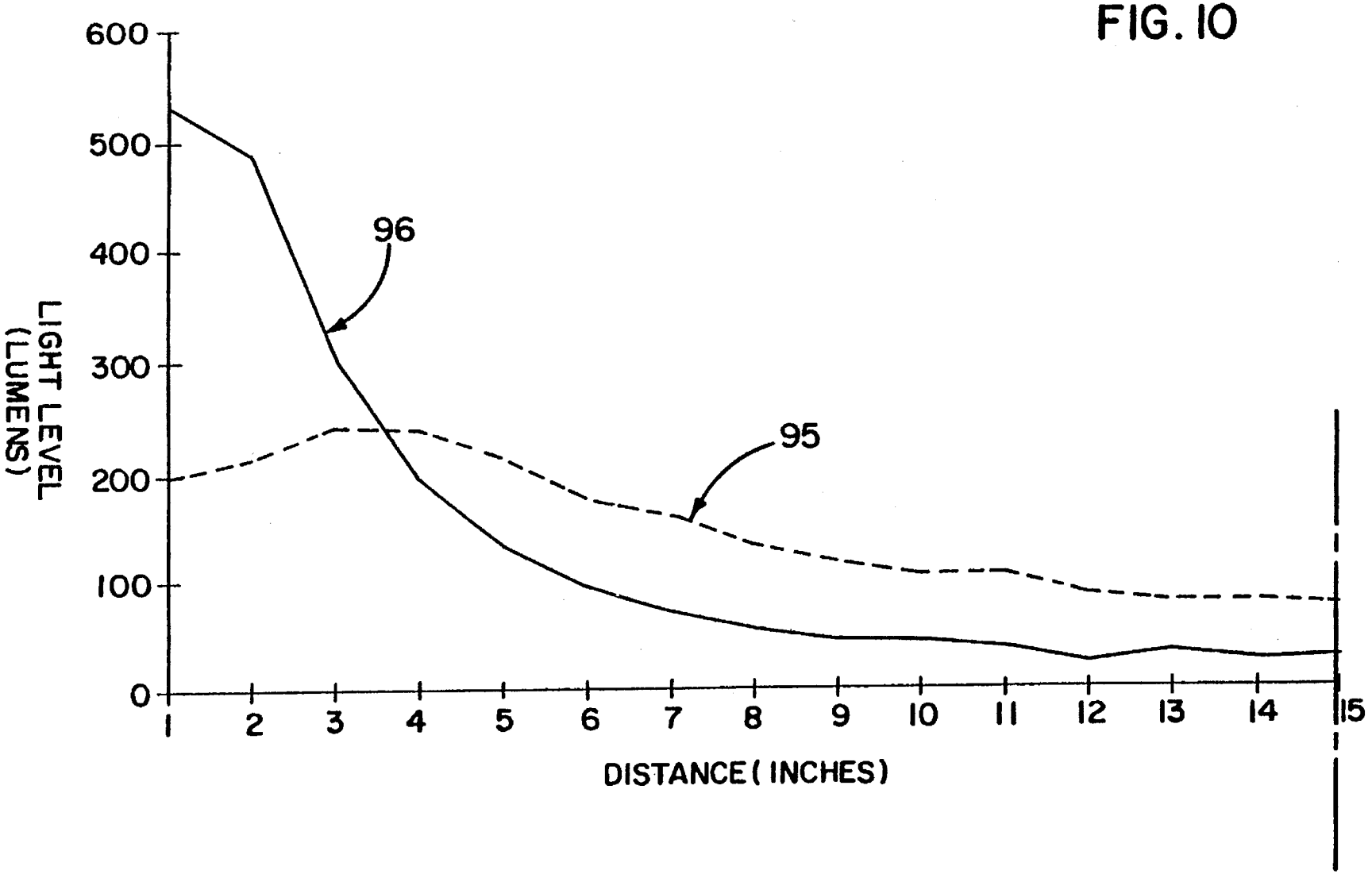
FIG. 10 is a graph illustrating the improvement in light distribution of the lighting system of the present invention when compared with a system having a bare fluorescent bulb.

Again referring to FIG. 3, it will be seen that the bulb 40 of the left-hand fixture 35 casts light generally toward the right and along the target plane TP, that the bulb 40 of the right-hand fixture 35 casts light generally toward the left, and that the bulb 40 of the center fixture 56 casts light in both directions. As a result, the center portions of each tier of shelves 30 are illuminated with light which has generally the same intensity as the light at the ends of the shelves. FIG. 10 is a graph showing the change in light level as a function of horizontal distance along the target plane TP from the light source and demonstrates the improvement obtained by the present lens/reflector system, where light level is indicated by a dashed line 95, as compared to a bare bulb of the same wattage and of the same physical size and shape, the light level of the bare bulb being indicated by the solid line 96. From FIG. 10, it is apparent that the light level of the present system is less adjacent the bulb but is greater remote from the bulb so as to provide a more uniform gradient.

The more uniform gradient not only casts more light on products remote from the source (i.e., at the center of each tier of shelves 30) but also reduces glare at the ends of the shelves. This, together with the retention of light within the fixtures 35 and 36, reduces the zebra effect and enhances the visibility of the colors and the graphics of the products.

Advantageously, each lens 55, 56 is clamped to the base 37 in a manner permitting quick and easy removal of the lens for purposes of changing the bulb 40. In the case of each of the end light fixtures 35, the insulating strip 21 includes a wing 100 (FIG. 4) which engages the flange 57 along the length thereof. Clamps 101 are spaced along the base and each includes a tongue 102 adapted to engage the side of the lens adjacent the wing. When a screw 103 is tightened, the tongue 102 pushes the lens to the left and presses the non-faceted portion 62 thereof against the strip 21, the flange 63 captivating the lens against rearward movement. By loosening the screws 103, the tongues 102 may be released from engagement with the lens and the latter may be pulled forwardly from the resilient flange 63 and wing 100.

Figure 6:
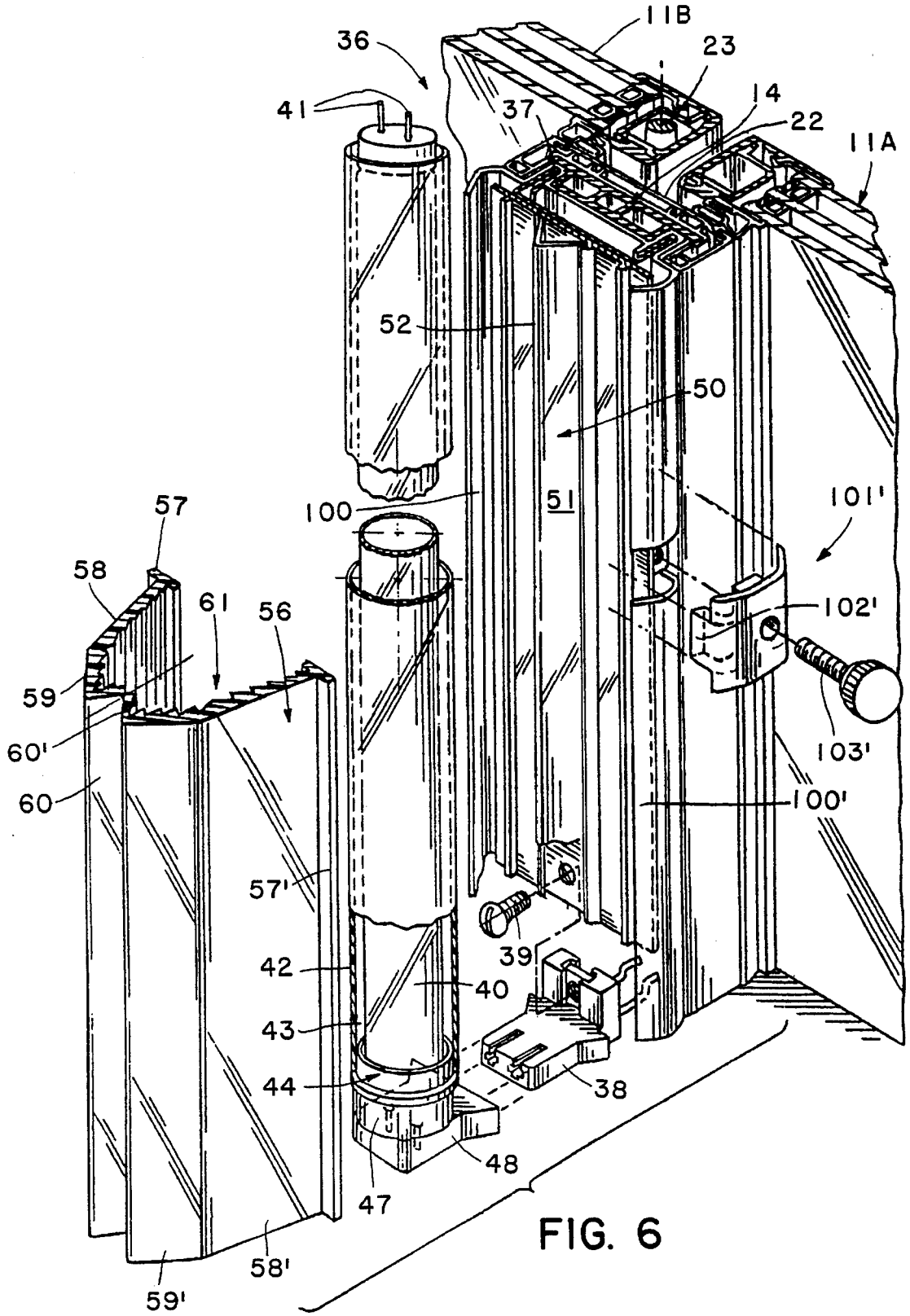
FIG. 6 is an exploded perspective view of certain components of the light fixture shown in FIG. 5.

A similar arrangement is used to hold the center lens 56. As shown in FIGS. 5 and 6, wings 100 and 100' made of resiliently yieldable plastic are fixed relative to the base 37 and engage the sides of the lens adjacent the flanges 57 and 57' thereof. Clamps 101 and 101' are spaced along opposite sides of the lens 56 and include tongues 102 and 102'. When screws 103 and 103' are tightened, the lens is clamped between the tongues. When the screws are loosened to release the tongues, the lens may be snapped forwardly past the wings.

It should be noted that the lens 55 and 56 coact with the tubes 42 to provide a double insulating jacket around each bulb. As a result, the bulbs are better protected from the cold temperatures in the refrigerator cabinet and are capable of producing greater light output.

We claim:

1. A refrigerator cabinet light fixture assembly comprising an elongated base for mounting within the refrigerator cabinet, an elongated fluorescent lamp bulb spaced from said base and having an axis extending substantially parallel to said base, a reflector located between said base and said bulb, a lens extending from said base and at least partially enclosing said bulb and said reflector in spaced relation with said bulb, said lens having a one-piece plastic construction and including a first portion connected to said base adjacent one side of said bulb and inclined at an acute included angle relative to said base so as to converge toward said bulb upon progressing away from said base, said first portion extending away from said base to a location beyond the axis of said bulb, said lens including a second portion inclined at an obtuse included angle relative to said first portion and extending away from said location and toward a second plane containing said axis and disposed perpendicular to a predetermined target plane parallel to said base, said second portion extending beyond said bulb, and said first and second portions having inner sides with multiple facets which coact with said reflector to redistribute light energy radiating from said bulb substantially uniformly across said target plane.

2. A light fixture assembly as defined in claim 1 in which said lens includes a third portion inclined at an acute included angle relative to said second portion and extending away from said second portion and toward said bulb to a location substantially in said second plane.

3. A light fixture assembly as defined in claim 2 in which said lens includes fourth, fifth and sixth portions which are mirror images of said first, second and third portions, respectively, said fourth portion being connected to said base adjacent the opposite side of said bulb, and said sixth portion being joined to said third portion substantially in said second plane.

4. A light fixture assembly as defined in claim 2 in which the inner side of said first portion of said lens includes a first group of generally V-shaped facets located between said base and a third plane extending parallel to said target plane and containing the axis of said bulb, each of the facets of said first group having long and short legs which join one another at an acute included angle, the long legs of the facets of said first group being generally parallel to one another and facing generally toward said reflector, the short legs of the facets of said first group being generally parallel to one another and facing generally away from said reflector.

5. A light fixture assembly as defined in claim 4 in which the inner side of said first portion of said lens also includes a generally V-shaped facet having legs joining one another at an obtuse included angle having an apex located closely adjacent said third plane.

6. A light fixture assembly as defined in claim 5 in which the inner side of said first portion of said lens includes yet another generally V-shaped facet located between said third plane and said target plane and having long and short legs which join one another at an acute included angle, the long leg of said last-mentioned facet extending substantially parallel to and facing said second plane.

7. A light fixture assembly as defined in claim 6 in which the inner side of said second portion of said lens includes a group of generally V-shaped facets each having long and short legs which join one another at an acute included angle, the long legs of said last-mentioned facets extending generally parallel to and facing said second plane.

8. A light fixture assembly as defined in claim 7 in which the inner side of said third portion of said lens includes a group of generally V-shaped facets each having long and short legs which join one another at an acute included angle, the long legs of said facets of said third portion being generally parallel to one another and facing generally away from said second plane, and the short legs of said facets of said third portion being generally parallel to one another and facing generally toward said third plane.

9. A light fixture assembly as defined in claim 8 in which said lens includes fourth, fifth and sixth portions having inner sides which are mirror images of the inner sides of said first, second and third portions, respectively, said fourth portion being connected to said base adjacent the opposite side of said bulb, and said sixth portion being joined to said third portion substantially in said second plane.

10. A refrigerator cabinet light fixture assembly comprising an elongated base for mounting within the refrigerator cabinet, an elongated fluorescent lamp bulb spaced from said base and having an axis extending substantially parallel to said base, a reflector located between said base and said bulb, a lens extending from said base and at least partially enclosing said bulb and said reflector in spaced relation with said bulb, said lens having an inner side with multiple facets which coact with said reflector to redistribute light energy radiating from said bulb substantially uniformly across a predetermined target plane extending substantially parallel to said base, said facets including a first group of generally V-shaped facets located between said base and a second plane extending parallel to said target plane and containing the axis of said bulb, each of the facets of said first group having long and short legs which join one another at an acute included angle, the long legs of the facets of said first group being generally parallel to one another and facing generally toward said reflector, and the short legs of the facets of said first group being generally parallel to one another and facing generally away from said reflector.

11. A light fixture assembly as defined in claim 10 in which the inner side of said lens also includes a generally V-shaped facet having legs joining one another at an obtuse included angle having an apex located closely adjacent said second plane.

12. A light fixture assembly as defined in claim 11 in which the inner side of said lens includes an additional generally V-shaped facet located between said second plane and said target plane and having long and short legs which join one another at an acute included angle, the long leg of said last-mentioned facet extending substantially parallel to and facing a third plane containing the axis of said bulb and disposed perpendicular to said target plane.

13. A light fixture assembly as defined in claim 12 in which the inner side of said lens includes a second group of generally V-shaped facets located between said additional facet and said target plane, each facet of said second group having long and short legs which join one another at an acute included angle, the long legs of the facets of said second group extending generally parallel to and facing said third plane.

14. A light fixture assembly as defined in claim 13 in which the inner side of said lens includes a third group of generally V-shaped facets each having long and short legs which join one another at an acute included angle, said third group of facets being located adjacent said second group of facets, the long legs of the facets of said third group being generally parallel to one another and facing generally away from said second plane, and the short legs of the facets of said third group being generally parallel to one another and facing generally toward said second plane.

15. A refrigerator cabinet light fixture assembly comprising an elongated base for mounting within the refrigerator cabinet, an elongated fluorescent lamp bulb spaced from said base and having an axis extending substantially parallel to said base, a reflector located between said base and said bulb, and a lens extending from said base and at least partially enclosing said bulb and said reflector in spaced relation with said bulb, said lens having an inner side with multiple facets which coact with said reflector to redistribute light energy radiating from said bulb substantially uniformly across a predetermined target plane extending substantially parallel to said base, means for releasably securing said lens to said base, said releasable securing means comprising clamps each having a tongue normally engaged with said lens to hold said lens in a fixed position on said base, and means for selectively releasing each clamp to enable the tongue thereof to be moved out of engagement with said lens.

16. A refrigerator comprising a refrigerator cabinet, a door assembly mounted within an opening in said cabinet, said door assembly including a door mounting frame having an outer peripheral portion about the cabinet opening, a pair of insulated glass doors mounted for pivotal movement on said frame between open and closed positions, said frame including three laterally spaced frame members extending between top and bottom sides thereof and against which said doors close, display shelves mounted within said cabinet behind said doors upon which items may be supported and viewed through said doors while said doors are closed, said shelves having front edges, a light fixture supported between said door frame and the front edges of said shelves, said light fixture including an elongated and upright base for mounting on said frame, an elongated and upright fluorescent lamp bulb spaced rearwardly from said base and having an axis substantially parallel to said base, a reflector located between said base and said bulb, and a lens extending rearwardly from said base and at least partially enclosing said bulb and said reflector in rearwardly spaced relation with said bulb, said lens having an inner side with multiple facets which coact with said reflector to redistribute light energy radiating from said bulb substantially uniformly and horizontally across a vertical target plane extending generally parallel to and spaced rearwardly from said base and located approximately at the front edges of said shelves.

17. A refrigerator as defined in claim 16 in which said reflector comprises a substantially V-shaped member having two wings supported by said base and having an apex pointing rearwardly toward said bulb and centered with respect to the axis thereof, said lens being of one-piece plastic construction and including a first portion connected to said base adjacent one of the wings of said reflector and inclined at an acute included angle relative to said base so as to converge toward said bulb upon progressing rearwardly away from said base, said first portion extending away from said base to a location behind the axis of said bulb, said lens including a second portion inclined at an obtuse included angle relative to said first portion and extending rearwardly from said first portion and toward a second vertical plane containing said axis and disposed perpendicular to said target plane, said second portion extending rearwardly to a location behind said bulb, and said lens including a third portion inclined at an acute included angle relative to said second portion and extending forwardly from said second portion and toward said bulb to a location substantially in said second plane.

18. A refrigerator as defined in claim 17 in which two of said frame members are end members and in which the third frame member is a center mullion located between said end members, said base being supported on said frame adjacent one of said end members, said lens extending around only a portion of said bulb, and baffling shielding another portion of said bulb to cause light energy to radiate through said lens.

19. A refrigerator as defined in claim 17 in which two of said frame members are end members and in which the third frame member is a center mullion located between said end members, said base being supported on said frame adjacent said center mullion, said lens including fourth, fifth and sixth portions which are mirror images of said first, second and third portions, respectively, said fourth portion being connected to said base adjacent the opposite wing of said reflector, and said sixth portion being joined to said third portion substantially in second plane.

20. A light fixture assembly as defined in claim 10 in which the inner side of said lens includes a second group of generally V-shaped facets located between said second plane and said target plane, each facet of said second group having long and short legs which join one another at an acute included angle, the long legs of the facets of said second group extending generally parallel to and facing a third plane containing the axis of said bulb and disposed perpendicular to said target plate, the short legs of the facets of said second group being generally parallel to one another and facing generally oppositely of the short legs of the facets of said first group.

21. A refrigerator comprising a refrigerator cabinet, a door assembly mounted within an opening in said cabinet, said door assembly including a door mounting frame having an outer peripheral portion about the cabinet opening, a pair of insulated glass doors mounted for pivotal movement on said frame between open and closed positions, display shelves horizontally mounted within said cabinet behind said doors upon which items may be supported and viewed through said doors while said doors are closed, a light fixture supported within said cabinet adjacent a side of said shelves, said light fixture including an upright elongated upright lamp bulb, a lens mounted inside said cabinet about said lamp bulb, and said lens being formed with multiple V-shaped facets which direct light emitted from said lamp bulb substantially uniformly and horizontally across a front of said shelves.

22. A refrigerator as defined in claim 21 in which said light fixture includes a reflector made of reflective material for redirecting light emitted from said bulb without permitting passage of light through said reflector, said lens being mounted about said bulb and reflector for directing light reflected by said reflector substantially uniformly and horizontally across a front of said shelves.

23. A refrigerator as defined in claim 22 in which said reflector comprises a substantially V-shaped member having an apex pointing towards a center of said bulb.

24. A refrigerator as defined in claim 21 in which said lens includes a first portion and a second portion disposed at an angle to said first portion, said first and second portions each being formed with V-shaped facets which direct light emitted from said bulb substantially uniformly and horizontally across a front of said shelves.

25. A refrigerator as defined in claim 24 in which said lens includes a third portion inclined at an angle to said second portion and formed with substantially V-shaped facets which direct light emitted from said bulb substantially uniformly and horizontally across a front of said shelves.

26. A refrigerator as defined in claim 21 in which said light fixture includes an elongated base mounted within said refrigerator cabinet, said bulb having an axis extending substantially parallel to said base, and said lens facets being formed to direct light emitted from said bulb substantially uniformly across a predetermined target plane extending substantially parallel to said base.

27. A refrigerator as defined in claim 26 in which said lens has of one-piece plastic construction and includes a first portion connected to said base adjacent one side of said bulb and inclined at an acute included angle relative to said base so as to converge toward said bulb upon progressing away from said base, said first portion extending away from said base to a location beyond the axis of said bulb, and said lens further including a second portion inclined at an obtuse included angle relative to said first portion and extending away from said location and toward a second plane containing said axis and disposed perpendicular to said target plane, said second portion extending beyond said bulb.

28. A refrigerator as defined in claim 27 in which said lens includes a third portion inclined at an acute included angle relative to said second portion and extending away from said second portion and toward said bulb to a location substantially in said second plane.

29. A refrigerator as defined in claim 28 in which said lens includes fourth, fifth and sixth portions which are mirror images of said first, second and third portions, respectively, said fourth portion being connected to said base adjacent the opposite side of said bulb, and said sixth portion being joined to said third portion substantially in said second plane.

* * * * *